United States Patent [19]

Banning et al.

[11] Patent Number: 4,906,207

[45] Date of Patent: Mar. 6, 1990

[54] DIELECTRIC RESTRAINER

[75] Inventors: Harmon W. Banning, Derwood, Md.; Thomas A. Clupper, Newark, Del.

[73] Assignee: W. L. Gore & Associates, Inc., Newark, Del.

[21] Appl. No.: 341,344

[22] Filed: Apr. 24, 1989

[51] Int. Cl.[4] ..... H01R 17/18
[52] U.S. Cl. ..... 439/578
[58] Field of Search ..... 439/578–585

[56] References Cited

U.S. PATENT DOCUMENTS

| | | | |
|---|---|---|---|
| 3,336,563 | 8/1967 | Hyslop | 439/578 |
| 3,678,444 | 7/1972 | Stevens et al. | 439/578 |
| 4,650,271 | 3/1987 | Forney, Jr. et al. | 439/578 |

*Primary Examiner*—Joseph H. McGlynn
*Attorney, Agent, or Firm*—Dena Meyer

[57] ABSTRACT

A coaxial cable connector is provided comprising an inner conductor, insulating material, outer conductor, and dielectric restrainer of molded polymeric material located in grooves selectively positioned between the inner conductor and insulating material and outer conductor and insulating material.

11 Claims, 5 Drawing Sheets

DIELECTRIC RESTRAINER

FIELD OF THE INVENTION

This invention relates to a dielectric restrainer for use with a coaxial cable connector having polytetrafluoroethylene (hereinafter PTFE) as the principal insulating medium between inner and outer conductors and a restrainer in the connector assembly that provides for the capture of the insulating medium.

BACKGROUND OF THE INVENTION

Coaxial connectors utilizing an insulating medium sometimes experience slippage or movement of the insulating medium with respect to the inner and outer conductors. This is a fairly common experience with commercially available coaxial cable assemblies such as SMA and SSMA. This slippage or in some instances separation of the insulation from and within the connector is also common under extreme ranges of temperature particularly in the range from −55° C. to 125° C.

Cable connector manufacturers have devised different techniques to correct the insulation slippage problem. One correction technique, known as epoxy cross pinning involves drilling a hole transversely through the outer conductor towards and through the insulation layer. Epoxy is then injected into this region to the inner conductor thus trapping the insulation and inner conductor. The inner conductor has a smaller diameter (undercut) in this region to hold the inner conductor in place. Often rather than having this undercut, the inner conductor is provided with grooves and knurls to prevent slippage of the center conductor.

The epoxy cross-pinning technique has several disadvantages. Since the epoxy used in the hole is not an adhesive but is instead a bulk material, a weak arrangement in the connector results. Further, the drilling of holes in the connector is expensive requiring a second operation or a special machine. There is also a tendency for the RF energy to leak out through the holes since the epoxy acts as a signal path. The drilling and injection of epoxy is time consuming and requires a curing process. The presence of epoxy having a dielectric constant appreciably higher than that of the insulation such as PTFE causes disturbances to the radio frequency energy and results in undesirable reflections which requires compensation to minimize these reflections.

Another technique to capture insulation in a coaxial cable is known as upsetting. In this method, several holes are drilled transversely substantially but not entirely through the outer conductor. After the insulation has been installed between the outer conductor and center conductor, a tool is used to punch through the holes drilled causing a burr to embed into the insulating material. Epoxy is then applied to "cover up" the openings. Disadvantages similar to those associated with epoxy cross-pinning also apply to this technique.

A third technique known as fish hook or barbs may also be used. In this application, the insulation is pressed into barbed regions created on the inner surface of the outer conductor. The insulation is prevented from slipping in one direction, however there remains easy movement in the opposite direction. The barbed technique also does not work well with insulating materials such as polytetrafluoroethylene because of its crushable properties and slick bearing surface. Further, this barbed region is difficult to manufacture.

Other techniques also exist but are less common.

There is a need for a coaxial connector assembly for capturing the insulation and center conductor of a coaxial cable connector to prevent movement of the components which does not create objectionable disturbances to the signal and maintains a high degree of shielding effectiveness with the coaxial cable.

SUMMARY OF THE INVNETION

A dielectric restrainer for a coaxial cable connector is provided in which the insulation is captured and restrained from movement by means of a plastic snap ring. The inner or center conductor is further restrained by a restrainer in a donut configuration. A third restrainer may also be used at the rear of the connector abutting the coaxial cable.

DETAILED DESCRIPTION OF THE PREFERRED EMBODIMENT

Figure 1:
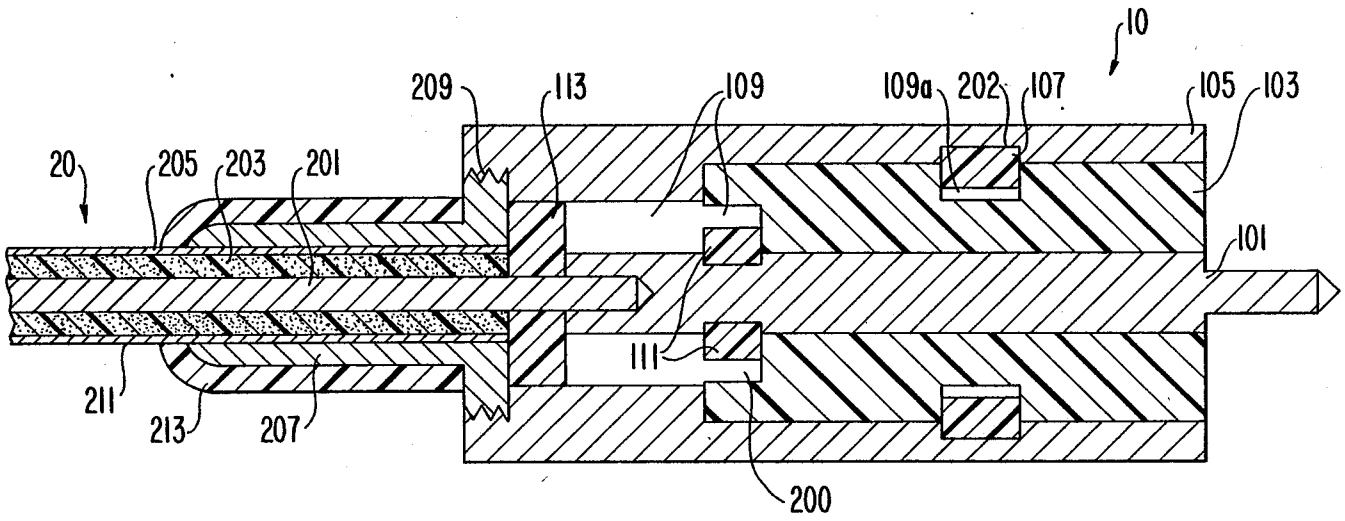
FIG. 1 is a cross-section of the coaxial connector assembly of the present invention with attached coaxial cable.

The invention is best understood by reference to the accompanying drawings. FIG. 1 shows a cross-section of a coaxial cable connector 10 with an attached coaxial cable 20. The connector further comprises an inner or center conductor 101, a dielectric insulating material 103, and an outer conductor 105. In one preferred embodiment, the center conductor 101 was made of gold plated beryllium copper, the outer conductor 105 was made from stainless steel and the insulating material 103 was made from polytetrafluoroethylene (hereinafter PTFE).

A dielectric restrainer in the shape of a partial ring or "C-ring" 107 was inserted in the groove at position 202. The restrainer 107 was made of a material possessing necessary mechanical properties including tensile strength, in this case having a shear strength of 100 pound, and capability of withstanding high temperatures. The restrainer also possessed desirable electrical properties such as having a specific dielectric constant higher than the insulating material, in this case a dielectric constant between 3 and 4, and also possessing a low loss tangent. Materials suitable and having these properties include Ultem (a polyetherimide) commercially available from General Electric and Torlon (a polyamide) commercially available from Amoco. Ultem has a dielectric constant of about 3.05 and Torlon has a dielectric constant of about 3.9.

Figure 2:
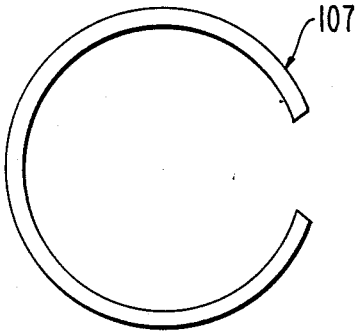
FIG. 2 is a side view of the "C-ring" dielectric restrainer used in the present invention.
Figure 2A:
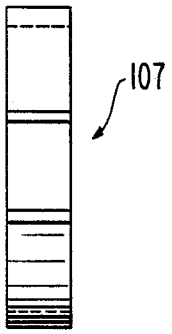
FIG. 2*a* is a front view of the "C-ring" dielectric restrainer.

A side view of the dielectric restrainer 107 is shown in FIG. 2 and a front view is shown in FIG. 2A. Preferably, the dielectric restrainer was injection molded and placed into the grooved position 202. By calculating the proper dimensions, the dielectric restrainer 107 was made to fit flush with the surface of the outer conductor 105 and to extend inward when compressed into the grooved area toward the insulating material 103. Prior to assembly, the insulator with the restrainer was inserted and positioned so as to be coincident with groove 202 found in the outer conductor. The restrainer expanded radially outward entirely filling the area abutting the outer conductor 105 and substantially filling in the grooved area to the insulating material, leaving a small air space 109*a* between the end of the restrainer and the insulating material. The peripheral edges of the restrainer abutted both the insulating material and outer conductor thereby restraining the insulating material from any lateral movement. The effect of air space 109*a* was neutralized by the difference in the dielectric constant of the restrainer compared with the dielectric constant of the insulating material. The size of the restrainer was selected to have comparable dimensions to that of the coaxial cable connector so that the presence of the restrainer was effectively neutralized thereby preventing any disturbances to the flow of radio frequency energy.

Figure 3:
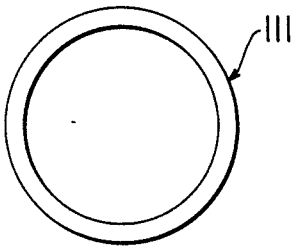
FIG. 3 is a side view of the "donut" dielectric restrainer used in the present invention.
Figure 3A:
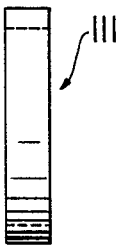
FIG. 3*a* is a front view of the "donut" dielectric restrainer.

A second restrainer may also be used to prevent any forward movement between the inner conductor 101 and the insulating material 103. In the preferred embodiment, a second groove at position 200 was machined into the inner conductor. A second dielectric restrainer 111, in the shape of a "donut" was molded around the conductor and within the groove at position 200. FIGS. 3 and 3A show the design of the restrainer. The materials used for the restrainer are the same as that used for the first restrainer 107. The restrainer 111 was positioned around the inner conductor 101 so that the inner diameter of the restrainer abutted the inner conductor 101 and the outer diameter abutted the air space 109. One side edge was pressed against the insulating material 103 and inner conductor 101 and the other side edge abutted an adjacent air space 109 and inner conductor 101. The effect of the restrainer 111 was neutralized by creation of this larger air space. The presence of this second restrainer 111 prevented any longitudinal movement of the inner conductor with respect to the insulating material 103.

Optionally, a third dielectric restrainer 113 may be positioned at the end of the inner conductor of the connector between the position of entry of the coaxial cable into the connector and the air space created by the second restrainer and insulating material. This restrainer may also be "donut" shaped and made from the same materials as described above, preferably a polyetherimide. This restrainer prevents rearward movement of the center conductor.

FIG. 1 also shows a cross-section of the coaxial cable 20 which may be suitable for this connector. Generally, any coaxial cable commercially available is suitable for this connector. Here, a center conductor 201 is positioned to mate with the center conductor of the connector 101. Surrounding the center conductor is a dielectric insulating material 203 preferably of expanded PTFE. Further surrounding the insulating material is an outer conductor 205. The coaxial cable is connected to the connector by a metal hat 207 that is provided with means for mating 209 with the outer conductor of the connector 105. FIG. 1 shows the mating means 209 to be a set of threads drilled into the conductors.

Also shown in FIG. 1 is a polymeric jacket 211 surrounding the outer conductor 205, made commonly of either FEP or PFA. Further surrounding the area of contact between the polymeric jacket 211 and hat 207 is a layer of polymeric shrink tubing 213.

EXAMPLE 1—DIELECTRIC RESTRAINER ELECTRICAL PERFORMANCE:

Three coaxial cables were constructed. One cable had no dielectric restrainer and served as a control. The second cable containing a dielectric restrainer in the shape of a C-ring was constructed in accordance to the procedures described in the specification in which the dielectric restrainer was made from Ultem. The third cable was constructed similar to the second however the dielectric restrainer in the shape of a C-ring was made from Torlon. Each cable was connected to a 40 GHz HP8510-B network analyzer to measure SWR and time domain reflection. SWR is the parameter used to measure the efficiency of signal transmittance. Time domain reflection, a measure of input impedance measured in ohms is used to measure the reflection of signal transmittance.

Figure 4:
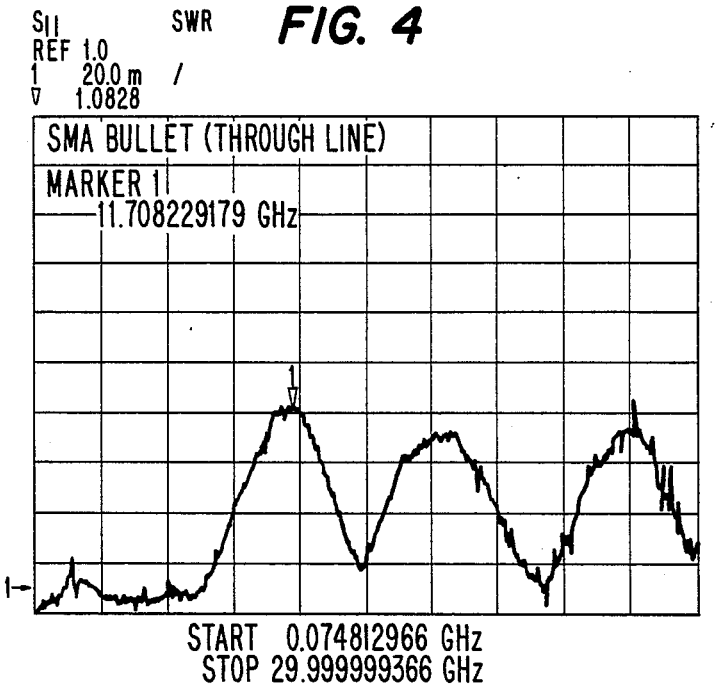
FIG. 4 is a plot of SWR for a conventional coaxial cable connector.
Figure 5:
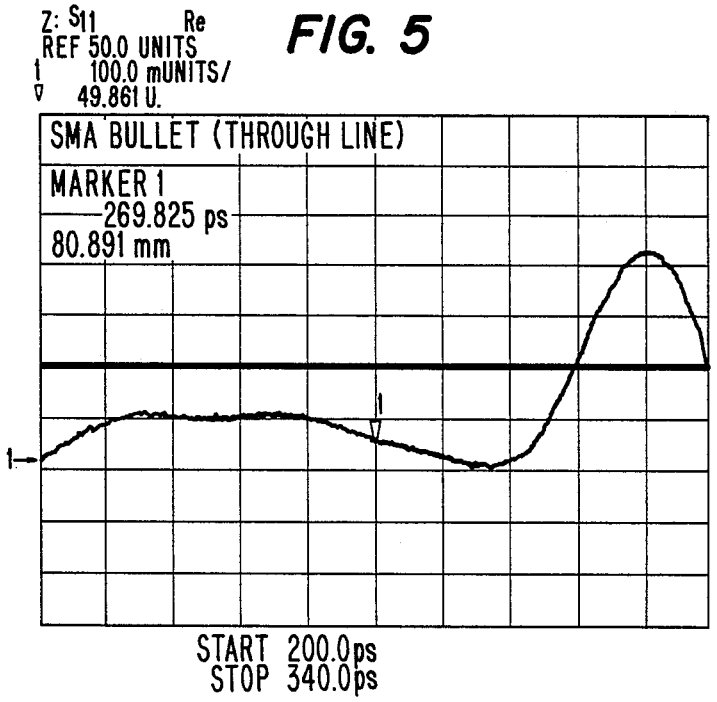
FIG. 5 is a plot of time domain impedance for a conventional coaxial cable connector.

FIGS. 4 and 5 are plots of SWR and time domain impedance of the cable having no dielectric restrainer. In FIG. 4, the plot of SWR showed a peak of 1.0828. In FIG. 5, the plot of time domain impedance showed a reflection of 49.861 U.

Figure 6:
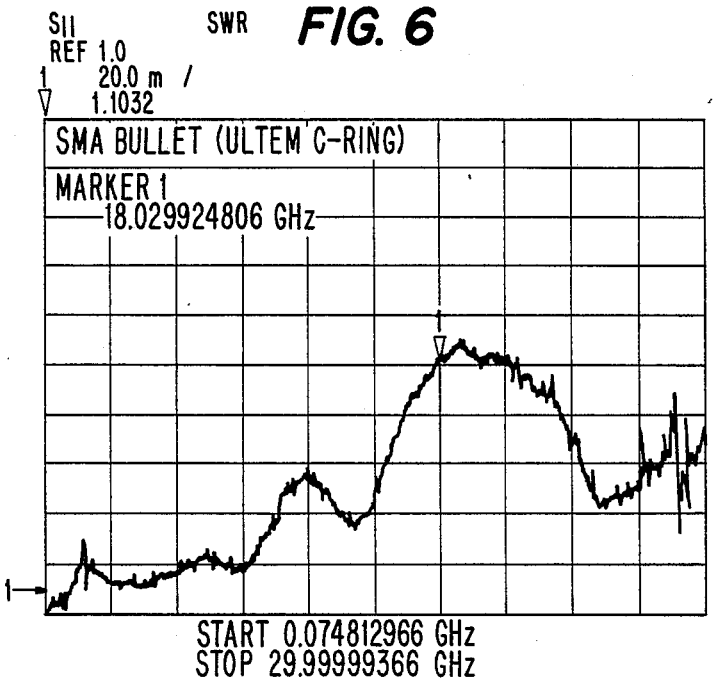
FIG. 6 is a plot of SWR of a coaxial cable connector made in accordance with the present invention using a restrainer made of Ultem®.
Figure 7:
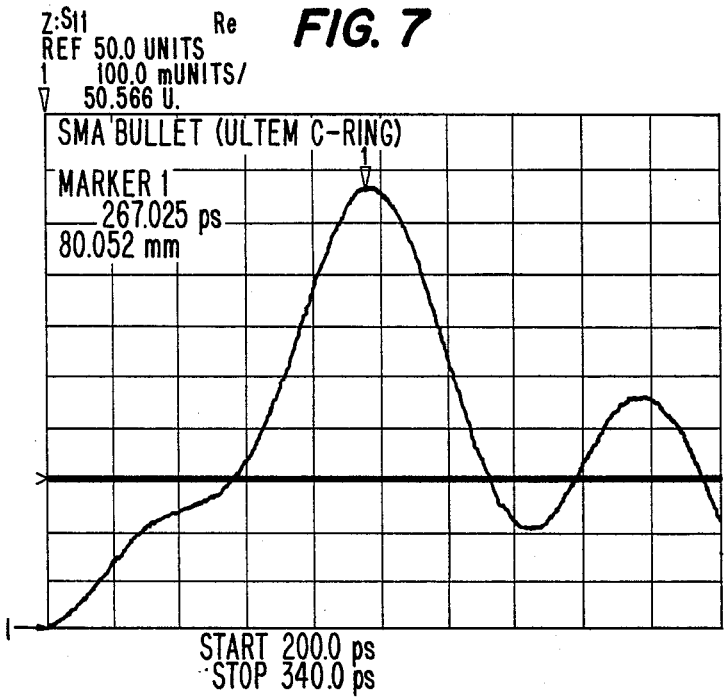
FIG. 7 is a plot of time domain impedance for a coaxial cable connector made in accordance with the present invention using a restrainer made of Ultem.

FIGS. 6 and 7 are plots of SWR and time domain impedance of the second cable having the dielectric restrainer of Ultem. The SWR showed a peak at 1.1032, slightly higher than the control however still acceptable. The time domain impedance showed a reflection of 50.566 U. The plot also shows an inductive hump at the position where the snap-ring is located.

Figure 8:
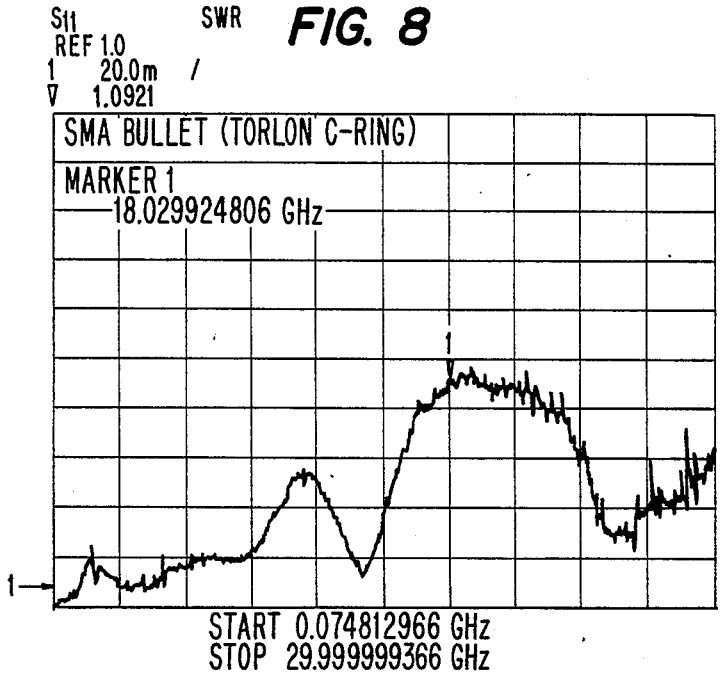
FIG. 8 is a plot of SWR of a coaxial cable connector made in accordance with the present invention using a restrainer made of Torlon®.
Figure 9:
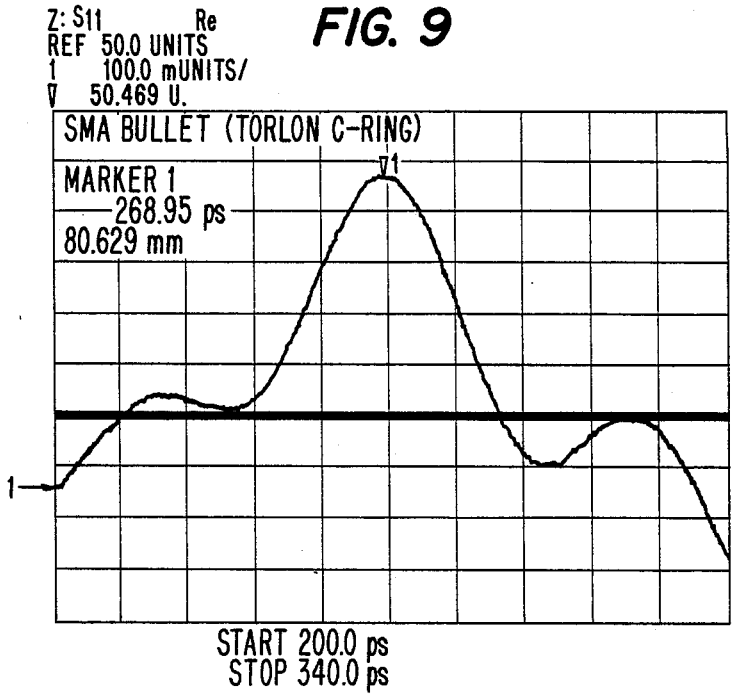
FIG. 9 is a plot of time domain impedance of a coaxial cable connector made in accordance with the present invention using a restrainer made of Torlon.

FIGS. 8 and 9 are plots of SWR and time domain impedance of the third cable having the dielectric restrainer made of Torlon. The SWR showed a peak at 1.0921 and the time domain impedance showed a reflection of 50.469 U. The SWR plot was similar to that of the cable having no dielectric restrainer. The time domain impedance showed an inductive hump but of lesser amplitude than that of the cable having the Ultem dielectric restrainer.

The preferred embodiments and example discussed above are presented only to illustrate the invention. Those skilled in the art will see that many variations of cable connector design can be made without departing from the gift of the invention.

We claim:

1. A coaxial cable connector comprising:

(a) an inner conductor, (b) a layer of dielectric insulating material surrounding the inner conductor, said insulating material having an inner and outer surface, (c) an outer conductor having an inner surface in contact with said outer surface of the insulating material wherein at least one groove is positioned between the contacting surfaces to create a space, and (d) a molded dielectric restrainer located substantially within the space between the insulating material and outer conductor.

2. A coaxial cable connector of claim 1 wherein said dielectric restrainer is an injection molding in the shape of a "C-ring" made of a polymeric material.

3. A coaxial cable connector of claim 2 wherein said polymeric material is polyetherimide.

4. A coaxial cable connector of claim 2 wherein said polymeric material is polyamide.

5. A coaxial cable connector of claim 1 further comprising at least one groove positioned between the contacting surfaces of the insulating material and inner conductor to create a space in which a molded dielectric restrainer is located substantially within the space between the inner conductor and insulating material.

6. A coaxial cable connector of claim 1 further comprising a dielectric restrainer between said inner conductor and outer conductor adjacent an air space at an end of the connector at which a coaxial cable is connected.

7. A coaxial cable connector of claim 5 wherein said molded dielectric restrainer is an injection molding of a polymeric material in the shape of a donut.

8. A coaxial cable connector of claim 8 wherein said dielectric restrainer is comprised of polyetherimide.

9. A coaxial cable connector of claim 8 wherein said dielectric restrainer is comprised of polyamide.

10. A coaxial cable assembly comprising:

(a) a coaxial cable, and (b) a coaxial cable connector, further comprising:

1. an inner conductor,
2. a layer of dielectric insulating material surrounding the inner conductor, said insulating layer having an inner surface in contact with the inner conductor, and an outer surface,
3. an outer conductor further surrounding said dielectric insulating material, said outer conductor having an inner surface in contact with the outer surface of the insulating material wherein at least one groove is positioned to create a space between the insulating material and outer conductor; and (c) a molded dielectric restrainer located substantially within the space between the insulating material and outer conductor.

11. A coaxial cable assembly of claim 11 further comprising at least one groove located between the inner conductor and insulating material to create a space, wherein a molded dielectric restrainer is located substantially within the space between the inner conductor and insulating material.

* * * * *